US007846266B1

(12) United States Patent
Dibiase

(10) Patent No.: US 7,846,266 B1
(45) Date of Patent: Dec. 7, 2010

(54) ENVIRONMENT FRIENDLY METHODS AND SYSTEMS FOR TEMPLATE CLEANING AND RECLAIMING IN IMPRINT LITHOGRAPHY TECHNOLOGY

(75) Inventor: Tony Dibiase, San Jose, CA (US)

(73) Assignee: KLA-Tencor Technologies Corporation, Milpitas, CA (US)

( * ) Notice: Subject to any disclaimer, the term of this patent is extended or adjusted under 35 U.S.C. 154(b) by 1330 days.

(21) Appl. No.: 11/356,879

(22) Filed: Feb. 17, 2006

(51) Int. Cl.
*B08B 7/04* (2006.01)
*B08B 7/00* (2006.01)

(52) U.S. Cl. ..... 134/30; 134/1; 134/1.1; 134/1.2; 134/1.3; 134/4; 134/6; 134/7; 134/26

(58) Field of Classification Search ..... 134/1, 134/1.1, 1.3, 1.2, 26, 30, 4, 6, 7
See application file for complete search history.

(56) References Cited

U.S. PATENT DOCUMENTS 6,371,134 B2 4/2002 Subramanian et al. ..... 134/1.2
6,927,176 B2 8/2005 Verhaverbeke et al. ..... 438/745
6,939,435 B1 9/2005 Tanaka et al. ..... 156/345.35
6,973,934 B2 12/2005 Tsuga et al. ..... 134/1.3
2009/0038636 A1 * 2/2009 Wuister et al. ..... 134/1

OTHER PUBLICATIONS

Gim S. Chen, "The Application of DI-O3 Water on Wafer Surface Preparation" downloaded from the internet on Feb. 7, 2006, downloaded from: <http://www.akrion.com/apex/pdfs/dio3prep.pdf#search='Gim%20S.%20Chen'>.
Applied Surfce Technologies "Carbon Dioxide Snow Cleaning" 1996, downloaded from the internet on Feb. 7, 2006, downloaded from <http://www.co2clean.com/cleaners.htm>.
D. Peters et al., "Development of Fluoride-Containing Solvent-Based Strippers" from *Future Fab International*, vol. 14, Issue 20, Feb. 11, 2003.

* cited by examiner

*Primary Examiner*—Alexander Markoff
(74) *Attorney, Agent, or Firm*—Joshua D. Isenberg; JDI Patent

(57) ABSTRACT

Cleaning and reclaiming nano-imprint templates using environment friendly methods and systems is disclosed. A template may be cleaned by a combination of exposure to activated gaseous species followed by rinsing with oxygenated or hydrogenated DI water and exposure to reactive plasma to remove organic contaminant. Contaminant may be removed by forming a coating film of a water soluble polymer on the template and then peeling off the coating film. Organic residue from the film may be removed using oxygenated plasma.

17 Claims, 3 Drawing Sheets

ENVIRONMENT FRIENDLY METHODS AND SYSTEMS FOR TEMPLATE CLEANING AND RECLAIMING IN IMPRINT LITHOGRAPHY TECHNOLOGY

GOVERNMENT INTERESTS

This invention was made with Government support under Grant No. N66001-02-C-8011 awarded by the Defense Advanced Research Projects Agency (DARPA). The Government has certain rights in the invention.

FIELD OF THE INVENTION

This invention generally relates to an apparatus and method for cleaning an imprint template. In particular, the present invention pertains to an environment friendly method and system for template cleaning and reclaiming in imprint lithography technology.

BACKGROUND OF THE INVENTION

Nano-imprint lithography (NIL) is a type of micro-fabrication technique that is becoming increasingly important in semiconductor processing and other applications. Imprint lithography provides greater process control and reduction of the minimum feature dimension of the structures formed. This in turn provides higher production yields and more integrated circuits per wafer, for example. Nano-imprint lithography can be used to form a relief image on a substrate, such as a semiconductor wafer. Nano-imprint lithography has two basic steps. The first step is imprint step in which a mold with a relief nanostructure on its surface is pressed into a thin resist film cast on to a substrate, followed by the removal of the mold.

Unlike conventional lithography methods, imprint lithography itself does not use any energetic beams. Therefore, nano-imprint lithography's resolution is not limited by the effects of wave diffraction, scattering and interference in a resist, and backscattering from a substrate. Imprint lithography systems often use an imprint head with a mold, also called a template, which can be installed and removed from the imprint head. This allows the imprint lithography system to be used to imprint different patterns. In this manner, the imprint lithography system can be used to fabricate various types of circuits or other devices, or imprint various structures on a substrate.

Nano-imprint lithography (NIL) has been identified as a possible candidate in realizing the 32-nm technology node in the semiconductor industry. The potential for NIL largely depends upon the ability of its proponents to demonstrate a faultless industrial implementation in all aspects. One such aspect that has acquired a rather sizable dimension in the early investigations is the issue of managing the NIL templates for contamination, pattern fidelity and longevity during production use.

Embodied within the concept of template contamination and pattern fidelity are all the attempts to generate a pattern surface free of particulate contamination as well as providing surface properties to template to ensure clean release after the imprinting. Similarly embodied within the concept of template longevity are all the attempts to maintain the continuous utilization of a template in a production environment, while maintaining the quality of the product within given specifications. Given that nano-imprint lithography is still an emerging technology; there are few standard procedures to achieve any of the goals described above.

The templates used in nano-imprint lithography require frequent periodic cleaning. Conventionally, these templates have been cleaned for first use by spraying them with sulfuric acid ($H_2SO_4$) followed by Nitrogen blow drying. To reclaim a template after use it is often necessary to remove contamination that occurs during production runs. Current methods of reclaiming a template after contamination during production runs involve repeating the wet chemical cleaning and manual surface treatment for release characteristics. Unfortunately, such wet cleaning can be expensive to implement, involves hazardous and corrosive chemicals that must be disposed of somehow. Disposal of such chemicals presents an environmental hazard that adds to the overall expense of wet chemical cleaning in particular and nano-imprint lithography in general.

Water soluble polymers have been used to clean optical surfaces. The film is spun on to an optical surface in liquid form, air dried and then peeled off. As the film is peeled off, inorganic particles and other contaminants on the optical surface stick to the film and are removed. Unfortunately after the film is removed an organic residue remains on the surface. It has been suggested that the residue may be removed by baking the optical surface, e.g., at about 250° C. Unfortunately, such baking may not sufficiently remove the organic residue. In addition, some optical surfaces, such as semiconductor wafers, photomasks and imprint templates would warp or be otherwise damaged by heating. If the film is water soluble, the residue could potentially be removed by rinsing in de-ionized water. However, a water rinse is usually not enough. A water rinse would typically need to be followed by drying with an alcohol vapor. This sequence of wet processing is typical, but involves quite a bit of equipment, as well as fire, and health hazards.

Organic solvents are typically used in the template manufacturing process to remove films such a photoresist after the patterning is finished. The solvents are used to dissolve the resist film, but the surface may require additional cleaning to remove any residues from the solvent resist stripping.

Thus, there is a need in the art, for a method for cleaning optical surfaces that overcomes the above drawbacks.

SUMMARY OF THE INVENTION

According to embodiments of the present invention nano-imprint templates may be cleaned in an environment friendly manner. A template may be cleaned by exposure to activated gaseous species with or without plasma, heat or UV light. The template is then rinsed with oxygenated or hydrogenated deionized (DI) water with or without megasonic to remove organic contaminants. The template is then dry cleaned with a reactive plasma, e.g., containing $O_2$ or $O_3$. Inorganic contaminants may be removed by forming a coating film of a water soluble polymer on a surface of the template. The coating film is peeled from the template to remove contaminants that stick to the film. Remaining organic residue can be removed from the template using a reactive plasma, e.g., containing $O_2$ or $O_3$.

BRIEF DESCRIPTION OF THE DRAWINGS

Other objects and advantages of the invention will become apparent upon reading the following detailed description and upon reference to the accompanying drawings in which.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Figure 1A:
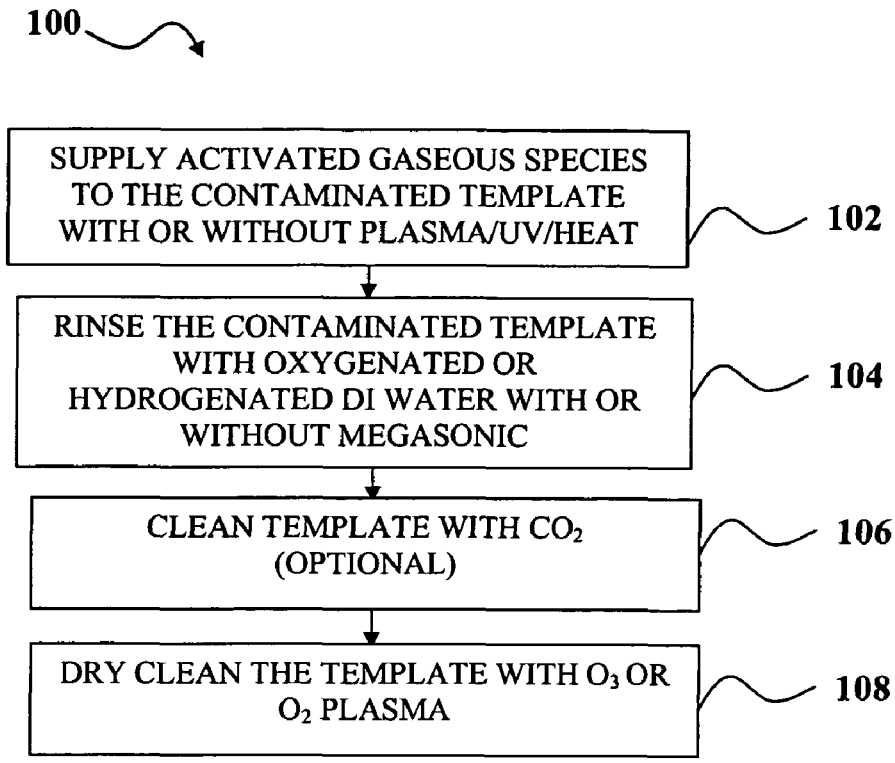
FIG. 1A is a flow diagram illustrating a method for cleaning a nano-imprint template according to an embodiment of the present invention.

FIG. 1A is a flow diagram illustrating an environmentally friendly method 100 for cleaning a nano-imprint template according to an embodiment of the invention. The method 100 may be used to clean a nano-imprint template for first use. Activated gaseous species are supplied to a contaminated surface of the contaminated template as indicated at 102. The activated gaseous species may include $O_2$ and $O_3$ and oxygen free radicals (O). In some embodiments, exposure to the activated gaseous species may take place while the nano-imprint template is placed on a sample stage inside of a vacuum processing chamber. Plasma, heat or UV light may optionally be applied to the activated gaseous species and/or the template at this stage. After treatment with the activated gaseous species, the template is rinsed with oxygenated or hydrogenated DI water as indicated at 104. Oxidizers, such as hydrogen peroxide ($H_2O_2$) or a variety of oxidizers in powder form, have been added to $H_2SO_4$. Embodiments of the present invention may use deionized water with ozone ($O_3$) added for oxygenation as described, e.g., by Gim S. Chen in "The Application of DI-03 Water on Wafer Surface Preparation" a copy of which may be obtained from the internet at http://www.akrion.com/apex/pdfs/dio3prep.pdf#search='Gim%20S.%20Chen'. Although it is not as strong as using sulfuric acid with peroxide, deionized water oxygenated with ozone is much safer. The DI water and/or template may be agitated, e.g. with megasonic agitation to assist in removal of organic contaminants at this stage. An optional $CO_2$ cleaning, indicated at 106, may be used for fine, ultra-critical cleaning processes.

The carbon dioxide cleaning may involve macroscopic hard and dense dry ice pellets, softer microscopic $CO_2$ "snow" particles, liquid $CO_2$ washing or supercritical fluid carbon dioxide ($SFCO_2$). These processes depends on either the liquid carbon dioxide solvent properties, energy and momentum transfer by an impacting solid phase, or a combination of both. Pellet systems rely upon the thermo-mechanical impact stresses related to the high impact velocity of macroscopic pellets for contamination removal—a momentum and energy transfer process. Snow sprays rely upon a combination of solvent action of liquid $CO_2$ and the momentum transfer of high velocity microscopic snow particles. The liquid based $CO_2$ washing systems rely upon the liquid phase solvent properties. Finally, the SFC systems rely exclusively upon carbon dioxide's unique supercritical fluid properties.

By way of example, $CO_2$ snow Cleaning systems rely on the expansion of either gaseous or liquid carbon dioxide. The output stream is usually a high velocity solid and gas mix and focused at the surface for cleaning. The most common commercial approach to the snow cleaning technology involves single expansion nozzles with high velocity outputs. The goal within the orifice and nozzle design is to have a constant enthalpy expansion and a high velocity stream. Asymmetric Venturi nozzles (supersonic nozzles) can yield these conditions. Other nozzle geometries give rise to high velocity snow streams but are less focused, may need nitrogen boosting, or can compromise organic removal abilities. Snow spray systems can remove both particulates and organic residues and can be formed with either a liquid or gas $CO_2$ source.

SFCO2 systems rely upon the solvent properties of $CO_2$ and other unique properties of a superfluid. This involves maintaining the pressure and temperature in the supercritical regime, above 31 C and 72.8 atmospheres. Generally, the SFCO2 units operate at much higher pressures and temperatures than the critical point. In a SFCO2 system, the items for cleaning are sealed in a vessel, the vessel is filled, and the temperature and pressure are adjusted. The superfluid has extremely low viscosity (low surface tension) and superior solvent properties than the liquid phase.

Liquid $CO_2$ washing systems use lower pressures that $SFCO_2$, e.g. cylinder pressure of about 800 psi. Although liquid $CO_2$ washing may lack the unique penetrating power of the superfluid phase, the lower pressures and easier equipment design allow for agitation and spin cycles that may assist in particle removal.

After rinsing, the template is then dry cleaned with a reactive plasma containing, e.g., oxygen ($O_2$) or ozone ($O_3$) as indicated at 108. The cleaned template may subsequently be used in an imprint process. It is noted that this process avoids wet cleaning with corrosive agents, e.g., acids such as $H_2SO_4$ or caustic agents such as ammonia in cleaning the template.

Figure 1B:
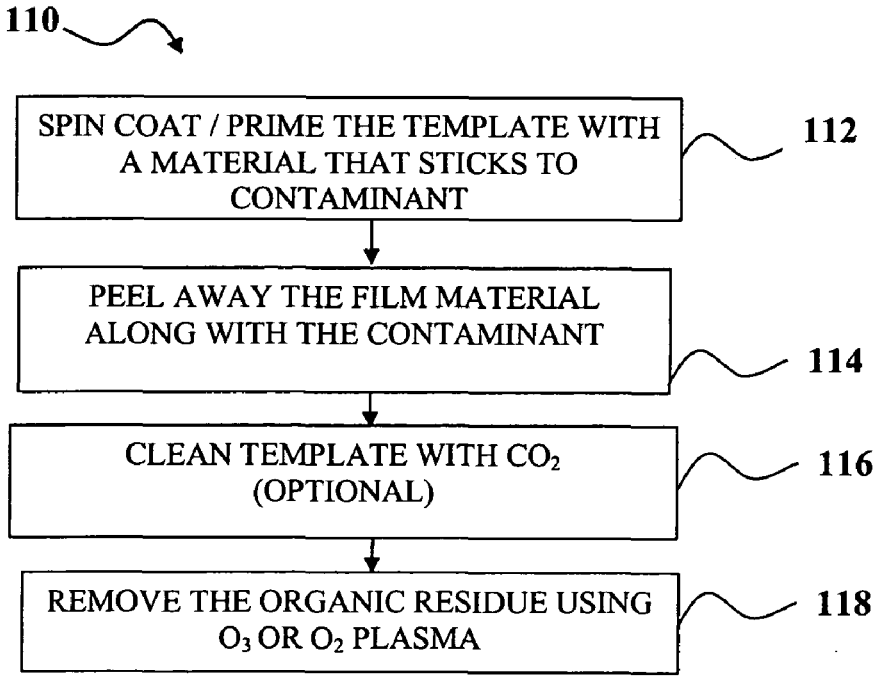
FIG. 1B is a flow diagram illustrating a method for removing contaminants from a nano-imprint template according to an alternative embodiment of the invention.

After an imprint lithography process a nano-imprint template may have contaminants, e.g., inorganic particles sticking on its surface. Removal of such contaminants facilitates reclamation of the template. FIG. 1B illustrates a method 110 for removal of contaminants from a nano-imprint template. As indicated at 112, a water soluble polymer, such as polyvinyl alcohol, is dispersed on the surface of the template to form a coating film of the water soluble polymer on the surface of the template, such that the inorganic contaminant will stick to the coating film. By way of example, and without limitation, the template may be placed on a spin chuck to spin coat a film of the water soluble polymer on the surface of the template. The film may then be peeled from the template surface at 114 thereby removing the contaminants. By way of example, a lift may be used to peel off the coating film containing the inorganic contaminant. Depending on the type of water soluble polymer, it may be desirable to allow the film to dry before peeling it from the surface of the template. After the film and contaminants have been removed an organic reside may remain on the surface of the template. An optional $CO_2$ cleaning at 116 may be used, e.g., as described above, for fine, ultra-critical cleaning processes. The organic residue may be removed using a reactive plasma, e.g., an oxygenated plasma containing $O_2$ or $O_3$.

It is noted that although FIGS. 1A and 1B depict particular sequences for cleaning operations these sequences are shown for the sake of example and are not to be construed as limitations upon the invention.

Figure 2A:
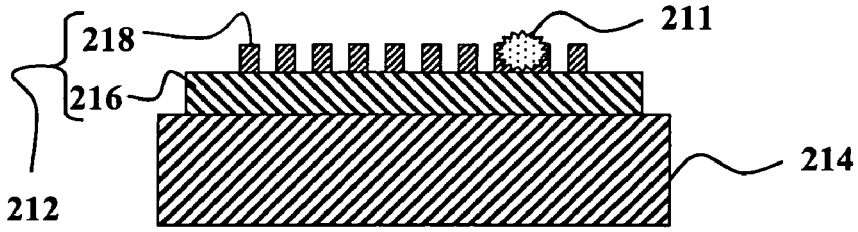
FIGS. 2A-2E are a sequence of schematic diagrams illustrating the steps of removing contaminants from a nano-imprint template using spin coating and peel off technique.
Figure 2B:
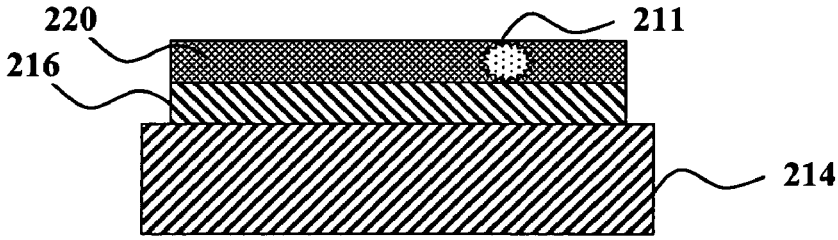
Figure 2C:
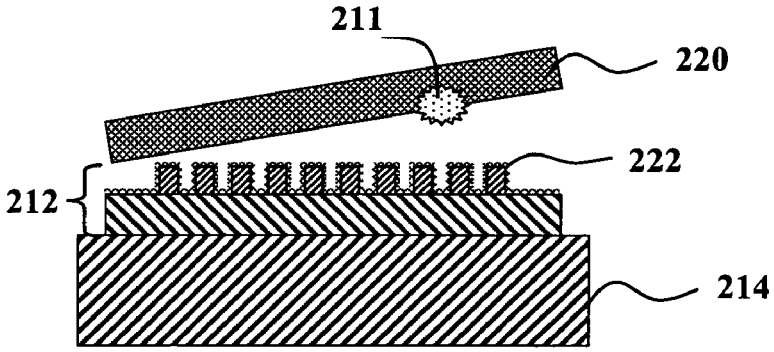
Figure 2D:
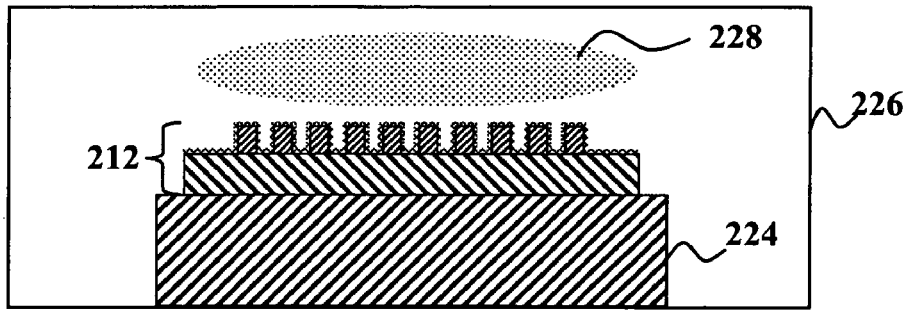
Figure 2E:
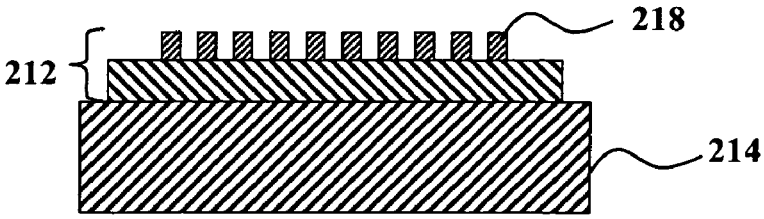

FIGS. 2A-2E are a sequence of schematic diagrams illustrating the method described in FIG. 1B. FIG. 2A shows a nano-imprint template 212, which includes a substrate 216 and features 218, placed on a spin chuck 214. An inorganic contaminant 211 is stuck on the features 218. FIG. 2B shows a coating film of water soluble polymer 220 formed on the template. The polymer film 220 may be applied to the template 212 by spin coating, e.g., dispensing the water soluble polymer onto the surface of the template in liquid form and spinning the template 212 by rotating the spin chuck 214. By way of example, the water soluble polymer film 220 may be made using a polyvinyl alcohol. An example of a suitable polyvinyl alcohol for forming a water soluble polymer is known as xFilm, which is commercially available from Transfer Devices, Inc. of Santa Clara, Calif. The coating film 220 is peeled off from the template with the inorganic contaminant 211 sticking to the coating film 220 as shown in FIG. 2C. The film 220 may leave behind an organic residue 222. To remove the residue 222, the template 212 may be placed on a substrate support 224 in a plasma reaction chamber 226 and exposed to a plasma 228 as shown in FIG. 2D. Reactive species from the plasma 228, e.g., $O_2$ or $O_3$, react with the organic residue 222 and remove it from the template leaving a cleaned template as shown in FIG. 2E. It is noted that this process avoids wet cleaning with corrosive agents, e.g., acids such as $H_2SO_4$ or caustic agents such as ammonia in cleaning the template 212.

Figure 3A:
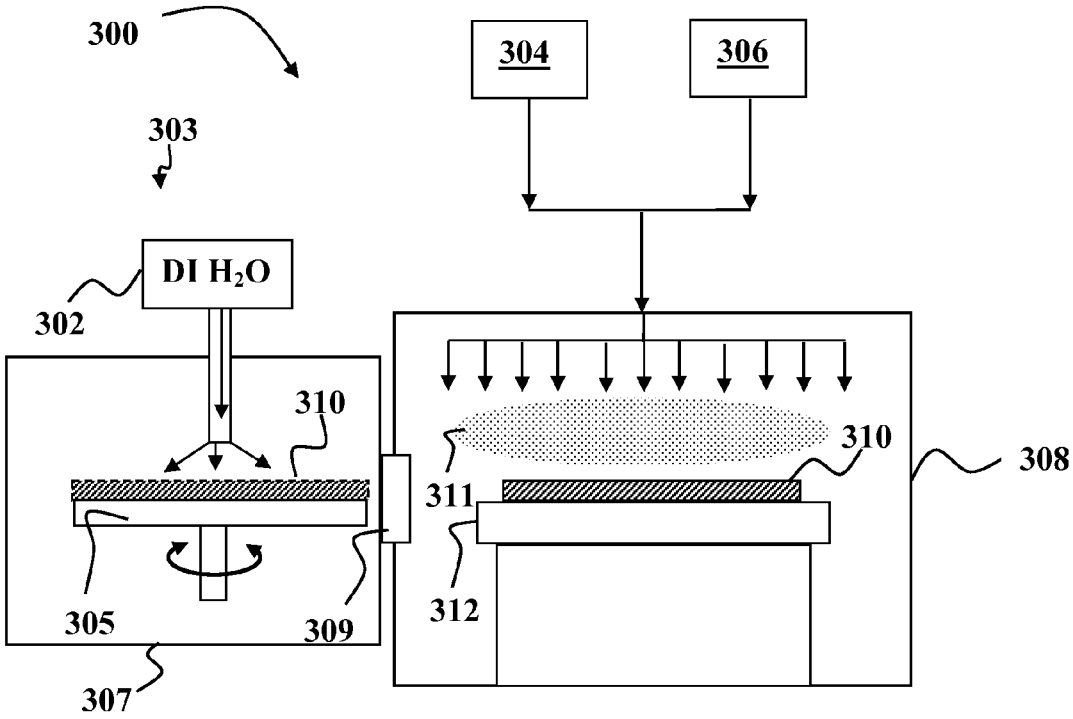
FIGS. 3A-3B are schematic diagrams of an apparatus for cleaning a nano-imprint template according to an embodiment of the present invention.
Figure 3B:
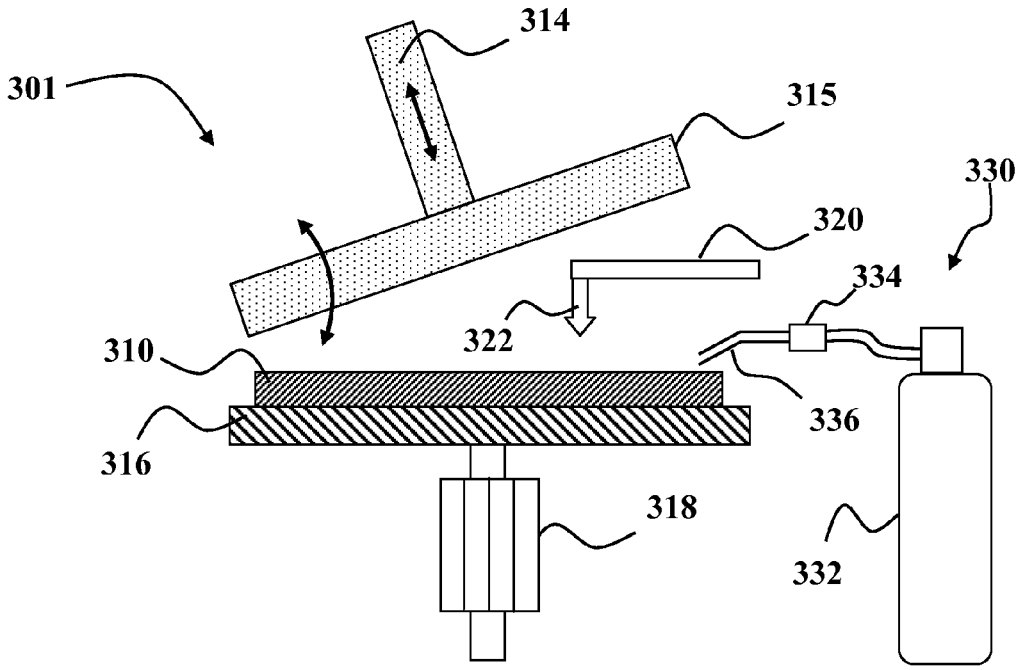

FIGS. 3A-3B depict examples of apparatus for cleaning of a nano-imprint template according to an embodiment of the present invention. The apparatus includes a processing system 300 for template cleaning as shown in FIG. 3A and a device 301 for external contaminant removal as shown in FIG. 3B. As shown in FIG. 3A, the system 300 includes a rinsing station 303, a processing chamber 308 with a processing gas supply unit 304 and a plasma generating device 306. At the rinsing station 303, a deionized water source 302 applies hydrogenated or oxygenated deionized water to a nano-imprint template 310. The rinsing station 303 may optionally include a spinning support 305 to spin the template 310 within a chamber 307 to facilitate drying. The support 305 and/or chamber may optionally include a transducer (not shown) to provide megasonic agitation to the template 310 and/or DI water.

After rinsing, the template 310 may be transferred to the vacuum chamber 308, e.g., through a slit valve, 309. The template 310 may rest on a sample stage 312 disposed in the vacuum processing chamber 308 during processing. A heating element may be incorporated into the chamber 308 and/or stage to facilitate heating of the template 310 during processing. The processing gas supply unit 304 supplies one or more process gases to the chamber 308. The process gases may include an inert gas such as argon for plasma initiation and one or more other gases that provide activated gaseous species, e.g., $O_2$ or $O_3$, and/or other dopants such as Fluorine, Chlorine or other halogens. It is noted that halogens, in sufficient concentration, may attack the material of the template (e.g., quartz). The object is to use an aggressive cleaning environment without damaging the template 310. The plasma generating device 306 supplies energy, e.g., in the form of radiofrequency radiation, DC voltage, or microwaves to the process gases to generate and sustain the reactive plasma 311 in the processing chamber 308. In a preferred embodiment, the plasma 311 is an oxygenated plasma, which may include $O_2$ and/or $O_3$ as reactive species.

In the example depicted in FIG. 3A, the deionized water supply 302 and processing gas supply 304 are depicted as being separate, they may alternatively be coupled to the same chamber 308.

Device 301 shown in FIG. 3B includes a spin chuck 316 for holding the nano-imprint template 310 horizontally and a motor 318 for rotating the spin chuck 316 in a horizontal plane. The device 301 also includes a dispenser 320 for dropping a coating liquid, such as a water-soluble polymer 322, on the surface of the nano-imprint template 310 and a lift 314 for peeling off the coating film on the surface of the nano-imprint template. The lift 314 includes a contact plate 315 that may be brought into contact with a film of the water soluble polymer. The contact plate 315 is made of a material to which the water soluble polymer readily adheres. When the lift 314 pulls the contact plate 315 away from the template 310 the contact plate 315 pulls the film away from the template 310. The lift 314 may pull the contact plate 315 away from the template 310 through some combination of translational and rotational motion.

In alternative embodiments, the template 310 may be mounted to a lift (not shown) that pulls the template away from the contact plate 315 through some combination of translational and rotational motion. In addition, some combination of motions of both the contact plate 315 and template 310 may accomplish separation of the water soluble polymer film from the template. In addition, the template 310 may be transferred between the system 300 and the device 301 to facilitate automated processing of the templates, thereby enhancing throughput.

In some embodiments, the system 300 may further include a high velocity carbon dioxide ($CO_2$) snow cleaning station 330 for fine ultra-critical cleaning processes. The $CO_2$ snow cleaning station includes a $CO_2$ source 332, a nozzle 334 with an internal orifice, an on/off valve 336, and the means to transport the $CO_2$ from the source to the nozzle. An example of a nozzle/valve assembly suitable for CO2 snow cleaning is a model K1-10, available from Applied Surface Technologies of New Providence, N.J.

Embodiments of the present invention allow for cleaning and reclaiming of wafers without the use of acids or caustic agents. Consequently, embodiments of the present invention may be implemented without the use of expensive and heavily regulated wet chemical cleaning equipment and the associated hazards and costs of disposal of the acids after use. Cleaning of nano-imprint templates according to embodiments of the present invention can be implemented in an environmentally friendly and economical manner with repeatable quality output.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature, whether preferred or not, may be combined with any other feature, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for cleaning a nano-imprint template, comprising:

supplying activated gaseous species to a surface having organic contaminants of the nano-imprint template;

rinsing the nano-imprint template with oxygenated or hydrogenated deionized (DI) water to remove the organic contaminants; and exposing the nano-imprint template to a reactive plasma to remove the organic contaminants, wherein the activated gaseous species include $O_2$ and $O_3$ and oxygen free radicals (O).

2. The method of claim 1 wherein the reactive plasma is an oxygenated plasma.

3. The method of claim 2 wherein the oxygenated plasma includes oxygen ($O_2$).

4. The method of claim 2 wherein the oxygenated plasma includes ozone ($O_3$).

5. The method of claim 2, wherein the oxygenated plasma includes other dopants.

6. The method of claim 5 wherein the dopants do not attack the substrate.

7. The method of claim 1, further comprising:

coating the nano-imprint template with a film of a coating liquid such that inorganic contaminants stick to the film;

peeling away the film along with the inorganic contaminants; and removing an organic residue left behind by the film using a reactive plasma.

8. The method of claim 7, further comprising drying the film of the coating liquid before peeling away the film along with the inorganic contaminants.

9. The method of claim 7 wherein the coating liquid is a water soluble polymer.

10. The method of claim 9 wherein the water soluble polymer is polyvinyl alcohol.

11. The method of claim 7 wherein coating the nano-imprint template includes spin-coating the template with the film of the coating liquid.

12. The method of claim 1 wherein said supplying activated gaseous species to a surface having organic contaminants of the nano-imprint template is performed using a plasma.

13. The method of claim 1 wherein said supplying activated gaseous species to a surface having organic contaminants of the nano-imprint template includes application of heat to the gaseous species and/or nano-imprint template.

14. The method of claim 1 wherein said supplying activated gaseous species to a surface having organic contaminants of the nano-imprint template includes application of ultraviolet (UV) radiation to the template and/or activated gaseous species.

15. The method of claim 1 wherein said rinsing the nano-imprint template with oxygenated or hydrogenated deionized (DI) water to remove the organic contaminants includes megasonic agitation of the oxygenated or hydrogenated deionized (DI) water and/or template.

16. The method of claim 1 wherein the nano-imprint template is cleaned without the use of wet cleaning with acids or caustic agents.

17. The method of claim 1, further comprising cleaning a surface of the template with carbon dioxide.

* * * * *